US005732881A

United States Patent [19]

Wolter

[11] Patent Number: 5,732,881

[45] Date of Patent: Mar. 31, 1998

[54] TREE WATERING DEVICE

[76] Inventor: James Wolter, 1103 Beverly Blvd S.W., Calgary, Alberta, Canada, T2V 2C4

[21] Appl. No.: 527,641

[22] Filed: Sep. 13, 1995

[51] Int. Cl.[6] ..... B05B 15/06

[52] U.S. Cl. ..... 239/1; 239/281; 239/536

[58] Field of Search ..... 239/273, 276, 239/279, 280–281, 285, 536, 1; 47/1.5, 1.7, 27, 66, 79, 48.5

[56] References Cited

U.S. PATENT DOCUMENTS

| | | | |
|---|---|---|---|
| 346,905 | 8/1886 | Gulick . | |
| 473,037 | 4/1892 | Wainwright | 239/276 X |
| 631,115 | 8/1899 | Hutchings | 239/281 X |
| 1,058,566 | 4/1913 | Dunlap | 239/279 X |
| 1,959,886 | 5/1934 | Wadsworth | 239/280.5 |
| 2,122,559 | 7/1938 | Dapero et al. | 239/273 |
| 2,694,600 | 11/1954 | Richey . | |
| 3,825,186 | 7/1974 | Heenan et al. | 239/280 |
| 4,438,620 | 3/1984 | Beardsley | 56/332 |
| 4,519,544 | 5/1985 | Szabo | 239/279 |
| 4,570,854 | 2/1986 | Wernhart | 239/189 |
| 5,390,853 | 2/1995 | Ellul | 239/282 |

FOREIGN PATENT DOCUMENTS

| | | | |
|---|---|---|---|
| 2649369 | 5/1978 | Germany | 239/276 |

*Primary Examiner*—Lesley D. Morris

*Attorney, Agent, or Firm*—Merchant, Gould, Smith, Edell, Welter & Schmidt, P.A.

[57] ABSTRACT

A tree watering device having an elongated tube constructed from tube sections connected end-to-end, a nozzle for spraying, a water inlet, and a hanger for securing the device to a limb of a tree. The hanger may include a hook that swivels to adjust to the angle of the limb to hold the limb more securely. Attachments with additional nozzles can be added between any two of the tube sections to spray water at intermediate heights.

7 Claims, 2 Drawing Sheets

TREE WATERING DEVICE

FIELD OF THE INVENTION

This invention relates generally to systems for watering the leaves, branches, trunk and roots of trees. More particularly, the invention concerns a new device and method for watering a tree where the operator can remain on the ground during installation and operation of the device.

BACKGROUND OF THE INVENTION

It is often important to water not only the roots of a tree but also the leaves, branches and trunk. Many of the current tree watering devices are designed to be used by commercial interests with large groves of trees. Such devices are often large portable sprayers designed to be moved between rows of trees. These devices are unsuitable for the individual homeowner because of their cost and because they cannot be conveniently disassembled and stored.

Other tree watering devices are essentially long pipes with attached spraying nozzles that are connected to an underground sprinkler system. Again, these systems are expensive and the pipes are often permanently mounted or have a base installed in the ground in which the pipe can be mounted. Either method is inconvenient for the typical homeowner.

Still other tree watering systems use long pipe sections of approximately the same height as the tree, which require the operator to climb a ladder in order to install or operate the system because the pipe sections are too awkward to balance and manipulate from ground level. This can be dangerous. It would be preferable for the operator to remain on the ground during the installation or operation of the watering device.

SUMMARY OF THE INVENTION

The present invention overcomes the drawbacks of previous systems. The present invention is relatively inexpensive, can be conveniently stored, and requires no additional installation of hardware. In addition, the present invention allows the operator to remain on the ground during installation and operation of the tree water device.

The present invention is an elongated tube which is constructed by joining several smaller tube sections end-to-end. A nozzle is attached to one end of the elongated tube and the other end of the tube terminates in an inlet which is connected to a pressurized water source such as a garden hose.

Also attached to the elongated tube is a hook that can secure the tree watering device to a tree limb. This hook can swivel from side-to-side to adjust to the angle that the limb makes with the tree resulting in an improved hold on the limb.

An attachment may be added between any two of the tube sections for additional spraying at intermediate heights. This attachment has one or more arms with nozzles at the end of each arm to spray water over the entire circumference of the tree. This attachment is especially useful for very tall trees.

As previously mentioned, this device can be installed and operated without a ladder. The elongated tube is constructed by taking one tube section, with the nozzle and hook attached, and raising the elongated tube parallel to the tree and to a height such that another tube section can be attached below. The operator secures the device to a tree limb with the hook and releases the tube. The operator then connects a second tube section to the first tube section. Additional tube sections are added in a similar manner until the device is long enough to water the entire tree. The operator then connects the water inlet of the device, which is attached to the last tube section, to a pressurized water source, such as a garden hose. After the desired period of watering is completed, the device can be disassembled by reversing the assembly steps.

Alternatively, some or all of the tube sections may be connected together, with supplemental watering members as needed, and then the entire assembly can be lifted into position. This requires, however, the operator to anticipate the correct location of hanger 32 so that the device will be positioned properly. This can be useful when the best branch on which to hang the hook is higher than the operator can reach with only one tube section.

Moreover, the present invention is advantageous in that it requires no foundation or stand for the device, but instead is supported by the tree itself. It is easily disassembled in about 20 to 30 minutes, allowing the operator to move from tree to tree so that multiple trees may be watered using only one inlet. It is easily drained, allowing watering of trees even in winter without freezing.

BRIEF DESCRIPTION OF THE DRAWINGS

For a more complete understanding of this invention reference should now be made to the embodiments illustrated in greater detail in the accompanying drawings and described below by way of examples of the invention. In the drawings.

DETAILED DESCRIPTION OF THE INVENTION

Figure 1:
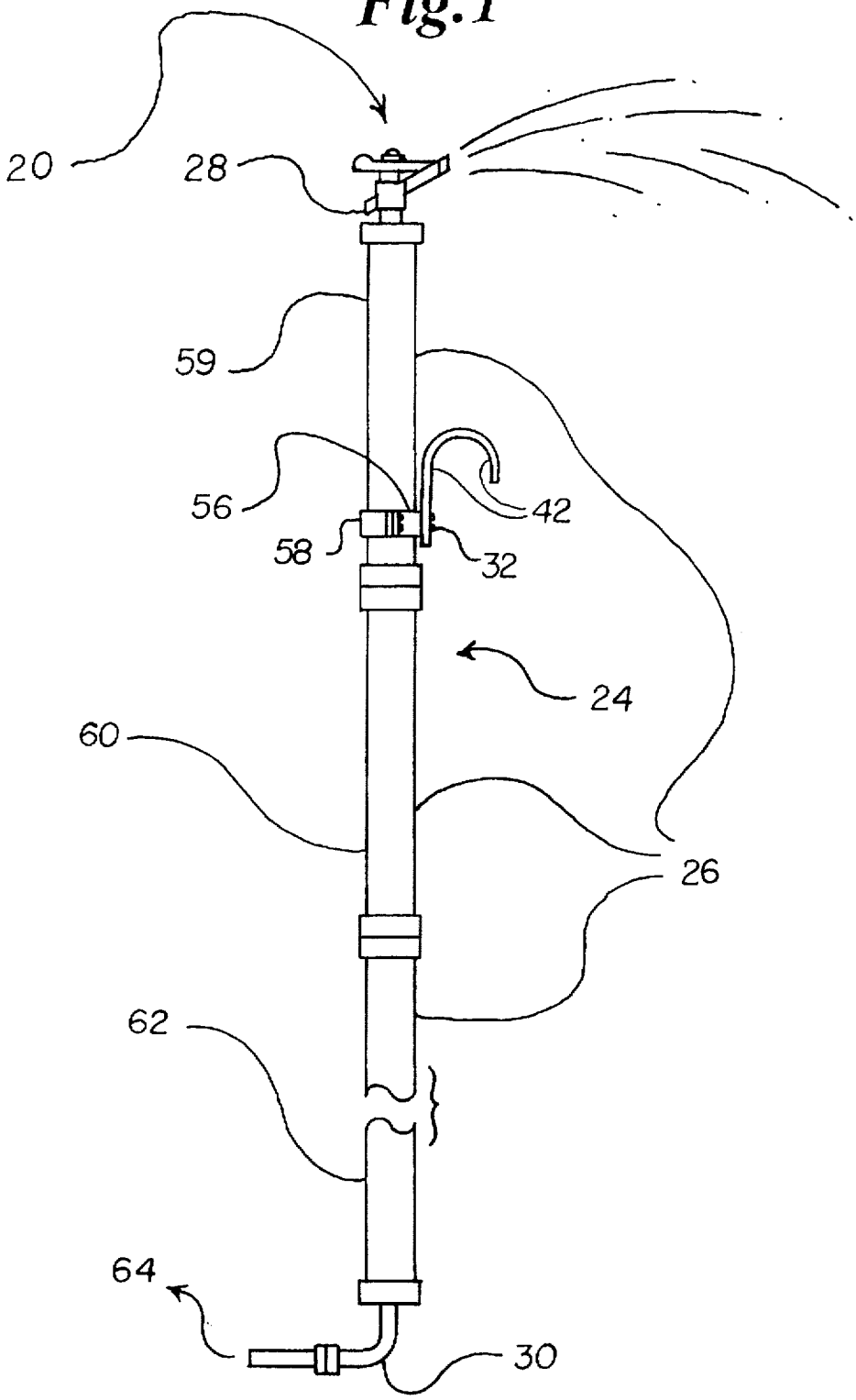
FIG. 1 is an overall perspective view of the device of the present invention.

Referring to FIG. 1, the device 20 includes an elongated tube 24 which is constructed by joining several tube sections 26 end-to-end. The tube sections 26 are preferably joined using ordinary tapered pipe threads. Of course, the tube sections can be connected using a friction fit or by any other suitable system for joining pipe sections which permits disassembly of the joined sections.

The tube sections 26 can be made of any type of plastic that is suitable for carrying water. Polyvinyl chloride (PVC) is the preferred material for these tube sections since it is widely available and relatively lightweight, strong and durable. The length of the tube sections 26 depends on the particular application, i.e., the height of the trees, the water volume to be carried, the water pressure to be accommodated, and the like. Generally, the tube sections 26 are preferably 6 to 8 feet in length and 1½ to 2 inches in diameter. A tube diameter of 1½ inches is preferable for a tree that is 40 feet in height. A tube diameter of 2 inches is preferable for a tree that is 60 feet or more in height.

The upper end of the elongated tube 24 is connected to a nozzle 28 and the lower end terminates in a water inlet 30. Preferably, the nozzle 28 should be readily removable from the elongated tube 24 so that a variety of nozzles can be interchangeably used to obtain different spray patterns. Preferably, the water inlet 30 is constructed so as to be connected easily to a convenient pressurized water supply 64, such as a garden hose.

Figure 2:
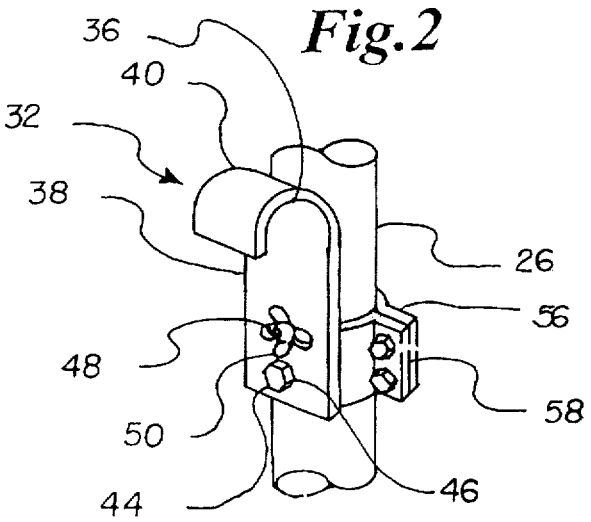
FIG. 2 is a detailed view of the hanger portion of the device shown in FIG. 1.

Attached to the tube 24 is a hanger 32 which can be secured to a tree limb. FIG. 2 shows the hanger 32 in more detail. The hanger 32 includes a metal or plastic hook 36 with a straight portion 38 and a curved portion 40. The curved portion 40 of the hook 36 should be of sufficient diameter 42 (see FIG. 1) such that the hook 36 can easily fit over the limbs of the tree to be watered.

In one embodiment of the invention, the straight portion 38 of the hook 36 has a hole 44 drilled in the straight portion's lower region of sufficient diameter that the hook 36 can rotate freely around a bolt 46 inserted into the hole 44. In addition, a crescent-shaped hole 48 exists near the center of the straight portion 38 of the hook 36. A second bolt 50 is placed within the hole 48. The hole 48 is shaped so that the hook 36 can swivel in either direction from a central position that is parallel to the elongated tube 24. This swiveling motion can alter the angle between the hook 36 and the elongated tube 24 to a maximum of 90° to either side of the central position. Preferably, the hook can swivel to a maximum of 80° to either side of the center position. The sides of the hole 48 frictionally engage the bolt 50 but remain loose enough that the position of the bolt 50 in the hole 48 can be easily adjusted by application of pressure on the hook 36. This configuration allows the hook to swivel easily and adjust its angle with respect to the elongated tube 24 to engage a tree limb better and more securely.

Both bolts 46, 50 are welded to, or cast into if plastic, a straddle member 56. A second straddle member 58 is securely fastened to the first straddle member 56. Both straddle members 56, 58 encompass and frictionally engage the elongated tube 24.

Figure 3:
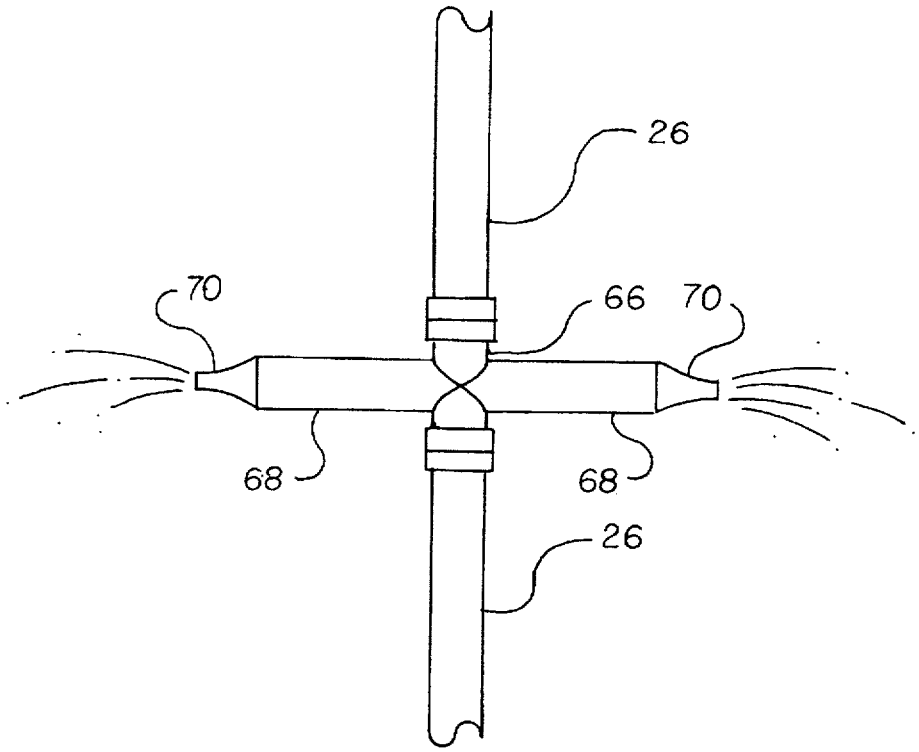
FIG. 3 is a detailed view of the supplemental water member which can be used in the device of FIG. 1.

In one embodiment of this invention, depicted in FIG. 3, a supplemental watering member 66 can be added between any two tube sections 24. The member 66 has one or more water-conveying outwardly-extending arms 68 with nozzles 70 at the end of each arm to spray water on the tree at intermediate heights. One configuration of this sprayer 66 has two arms 68 which are separated by 180° and are perpendicular to the elongated tube 24. This configuration sprays water over the entire circumference of the tree.

The tree watering device 20 is operated in the following way. The operator takes a tube section 59 with a nozzle 28 at the upper end and the hanger 32 frictionally attached to the tube 59. The operator lifts the tube section 59 parallel to the tree and near the trunk. The tube section 59 is lifted to a height such that a second tube section 60 could easily be attached to the lower end of the first tube section 59. The operator secures the device to a tree limb using the hanger 32 so that when the operator releases the tube 24, the device 20 will stay in place in the tree. A second tube section 60 is then connected to the first tube section 59 thereby creating an elongated tube 24. The operator grasps the second tube section 60 and disengages the hanger 32 from the limb.

Additional tube sections 26 or supplemental watering members 66 are added to the device 20 by the same process until the nozzle 28 reaches the desired height. The operator then leaves the hanger 32 attached to the limb. The last tube 62 added to the device 20 should have the water inlet 30 on its lower end. A pressurized water source 64 is attached to the water inlet 30 and water is allowed to flow into the device to be sprayed onto the tree through the nozzle 28 or through the nozzles 70 that are attached to any supplemental watering members 66 that have been included in the device 20. After spraying for the desired period of time, the device 20 can be disassembled by reversing the assembly process.

Alternatively, some or all of the tube sections may be connected together, with supplemental watering members as needed, and then the entire assembly can be lifted into position. This requires, however, the operator to anticipate the correct location of hanger 32 so that the device will be positioned properly. This can be useful when the best branch on which to hang the hook is higher than the operator can reach with only one tube section.

This device provides a simple, efficient, and relatively inexpensive method for watering the trunk, limbs, and leaves of a tree without requiring the operator to use a ladder or similar device to install the watering means in the upper reaches of a tall tree. The operator need never leave the ground to water his trees.

While the invention has been described in connection with an embodiment, it will be understood that the invention is not limited to that embodiment. The invention is intended to cover all alternatives, modifications, and equivalents as may be included within the spirit and scope thereof, as defined by the appended claims.

What is claimed is:

1. A method of watering a tree comprising: assembling an elongated tube by the following method:

a) raising a first tube section substantially parallel to the tree, said first tube section having first and second ends, a nozzle attached at said first end and a tree-engaging means mounted on said first tube section;

b) engaging a tree limb with said engaging means so as to support said first tube section from the tree at a height sufficient to allow a second tube section to be attached to the second end of the first tube section;

c) connecting said second end of said first tube section to an end of a second tube section to form an elongated tube;

d) repeating steps b) and c) to add additional tube sections until the desired length is attained;

supplying water from a pressurized source to said elongated tube such that water is ejected from said nozzle, said water being supplied for a desired period of time.

2. The method of claim 1, further comprising the step of disassembling said elongated tube after water has been supplied for the desired time period by reversing the assembly steps.

3. The method of claim 1, wherein said engaging means is a hook of sufficient size to fit over said limb of said tree.

4. The method of claim 1, wherein said engaging means is mounted to the elongated tube with a swivel such that said engaging means swivels to conform with the angle of the limb with said tree.

5. The method of claim 1, further comprising an additional watering member disposed in fluid communication with two of the tube sections, said additional watering member comprising at least one water-conveying, outwardly-extending arm and a nozzle at the end of said arm.

6. The method of claim 5, wherein said additional watering member includes two arms.

7. The method of claim 6, wherein the two arms are 180° apart and perpendicular to said elongated tube.

* * * * *